US005757266A

United States Patent [19]

Rider et al.

[11] Patent Number: 5,757,266

[45] Date of Patent: May 26, 1998

[54] ELECTRONIC APPARATUS FOR PROVIDING PLAYER PERFORMANCE FEEDBACK

[76] Inventors: Alan J. Rider, 12206 Quron Ln., Reston, Va. 20191; Lester R. Querry, 2274 Crows Nest Ln., Reston, Va. 20191; Stephen Landsman, 117 Nelson Rd., Baltimore, Md. 21208

[21] Appl. No.: 665,266

[22] Filed: Jun. 17, 1996

Related U.S. Application Data

[63] Continuation-in-part of Ser. No. 659,838, Jun. 7, 1996, abandoned.

[51] Int. Cl.[6] ..... A63B 61/00

[52] U.S. Cl. ..... 340/323 R; 273/29 A; 273/73 D; 364/411; 434/238

[58] Field of Search ..... 340/323 R; 273/29 A, 273/73 D, 73 R; 434/238, 247; 364/411

[56] References Cited

U.S. PATENT DOCUMENTS

| | | | |
|---|---|---|---|
| 4,101,132 | 7/1978 | Conrey et al. . | |
| 4,257,594 | 3/1981 | Conrey et al. . | |
| 4,822,042 | 4/1989 | Landsman . | |
| 4,852,875 | 8/1989 | McLennan et al. . | |
| 4,870,868 | 10/1989 | Gastgeb et al. | 273/29 A |
| 4,940,236 | 7/1990 | Allen . | |
| 5,031,909 | 7/1991 | Pecker . | |
| 5,080,362 | 1/1992 | Lillard | 273/73 R |
| 5,409,213 | 4/1995 | Yeh . | |

FOREIGN PATENT DOCUMENTS

| | | |
|---|---|---|
| 0 291 621 A1 | 11/1988 | European Pat. Off. . |
| 0 455 105 A1 | 9/1991 | European Pat. Off. . |
| 2 626 481 | 8/1989 | France . |
| 1405857 A1 | 10/1986 | U.S.S.R. . |
| 1528513 A1 | 12/1987 | U.S.S.R. . |
| 1602563 A1 | 6/1988 | U.S.S.R. . |
| 3929459 C1 | 9/1989 | U.S.S.R. . |
| 2 250 923 | 6/1992 | United Kingdom . |

OTHER PUBLICATIONS

Maryland Match Point, Maryland's Regional Tennis Publication, "At the Sound of the Beep, Improve Your Stroke", Nov. 1995, vol. 1, pp. 10–11.

*Primary Examiner*—Edward Lefkowitz

[57] ABSTRACT

An electronic system for incorporation in a racquet that monitors a player's ability to hit balls within a specific region on the string bed. A plurality of sensors are positioned around the periphery of the racquet string bed for detecting the relative time-of-arrival of transverse waves produced by impacts of balls on the string bed. A circuit incorporated within the racquet receive the signals from the sensors and provide a plurality of signals from which the position of impact on the string bed may be calculated. The system incorporates a low power microprocessor that is programmed to compute the ball impact location from the signals produced by the sensors. A display device on the racquet displays information derived from the calculated impact location to permit players to assess their performance as related to hitting a predetermined region. A sound generator is incorporated that emits audible signals having an amplitude, frequency and duty cycle that indicate relative positions of impact on the string bed. The system provides for statistical reporting of impacts as either percentages within a zone or a total tally of impacts. A user interface is provided permitting selection of various modes of operation. The microprocessor architecture and programming is optimized for lower power consumption while providing adequate resolution of impact locations.

41 Claims, 10 Drawing Sheets

ELECTRONIC APPARATUS FOR PROVIDING PLAYER PERFORMANCE FEEDBACK

RELATED APPLICATIONS

This is a continuation in part application of an application filed Jun. 7, 1996, entitled ELECTRONIC APPARATUS FOR MONITORING PLAYER PERFORMANCE Ser. No. 08/659,838, now abandoned.

BACKGROUND OF THE INVENTION

The present invention relates to an electronic device incorporated in a sports racquet for monitoring a player's ability to hit a ball on a specific location on the racquet. Specifically, a device is disclosed for locating the position of impact of a ball on a racquet string bed and signalling to the player information relating to the impact.

Electronic athletic instruments for measuring the point of impact of a ball on a racquet string bed are described in U.S. Pat. Nos. Nos. 4,822,042 and 4,101,132. These devices which are directed to sports racquets provide for user feedback during a game by signalling to the user the relative position of the impact of a ball striking the racquet string bed. As is known to sports players, the sports racquet string bed has a preferred zone for striking the ball to generate the maximum force for returning the ball which is generally located in the center of percussion of the racquet. The better players tend to use a very small region of this area on the string bed, known as the sweet spot, for providing return shots of the ball. For lower skilled players, impacts occur with greater frequency outside the desired zone of impact.

Training the athlete to improve the number of impacts within the sweet spot is improved when an immediate assessment can be made of the location of the hit with respect to the sweet spot of the string bed. U.S. Pat. Nos. No. 4,822,042 describes a system for immediately detecting the ball impact location on the string bed, and signalling the location to the user.

The instrumentation for monitoring impact locations must preferably be battery operated, and power consumption of such instrumentation must also be maintained at an absolute minimum. Incorporating instrumentation for carrying out these objectives on a sports racquet is also made difficult by the extreme limitation on the amount of additional weight which can be added to the racquet without interfering with player performance.

SUMMARY OF THE INVENTION

It is an object of this invention to provide a device for detecting and reporting the impact location of a ball on the string bed of a sports racquet.

It is a more specific object of this invention to provide instantaneous feedback to a player during play regarding the players ability to consistently hit a preferred region on a sports racquet.

It is still another object of this invention to provide for an electronic circuit incorporated within a sports racquet which accumulates information concerning the location of successive impact locations of the ball on the string bed of a racquet.

These and other objects of the invention are provided by an electronic circuit incorporated within a sports racquet, such as is used to play the game of sports, or other playing instrument, which monitors player performance. A plurality of sensors are supported around the periphery of a string bed of the racquet which detect the relative time-of-arrival of a transverse wave produced from the impact of the string bed with a ball. Circuit means incorporated in the racquet receive the signals from the sensors, and provide a plurality of signals from which the position of impact on the string bed may be calculated. The circuit means incorporates a low power microprocessor which is programmed to compute the ball impact location from the sensor signals. A display device on the racquet displays information derived from the calculated impact location to permit players and or their instructors to assess their performance.

In a specific embodiment of the invention, the display indicates whether the location of the impact is within a predefined zone corresponding to a sweet spot area on the string bed. The microprocessor may be advantageously programmed to provide statistical summaries of consecutive impact locations on the string bed with respect to the sweet spot area and display these summaries on the display.

In the same specific embodiment of the invention, a sound generator is incorporated in the device which will emit a sound indicative of the impact location. Users of the device receive immediate feedback from each measured impact representing the relative impact location on the string bed of the racquet.

DESCRIPTION OF THE PREFERRED EMBODIMENT

Figure 1A:
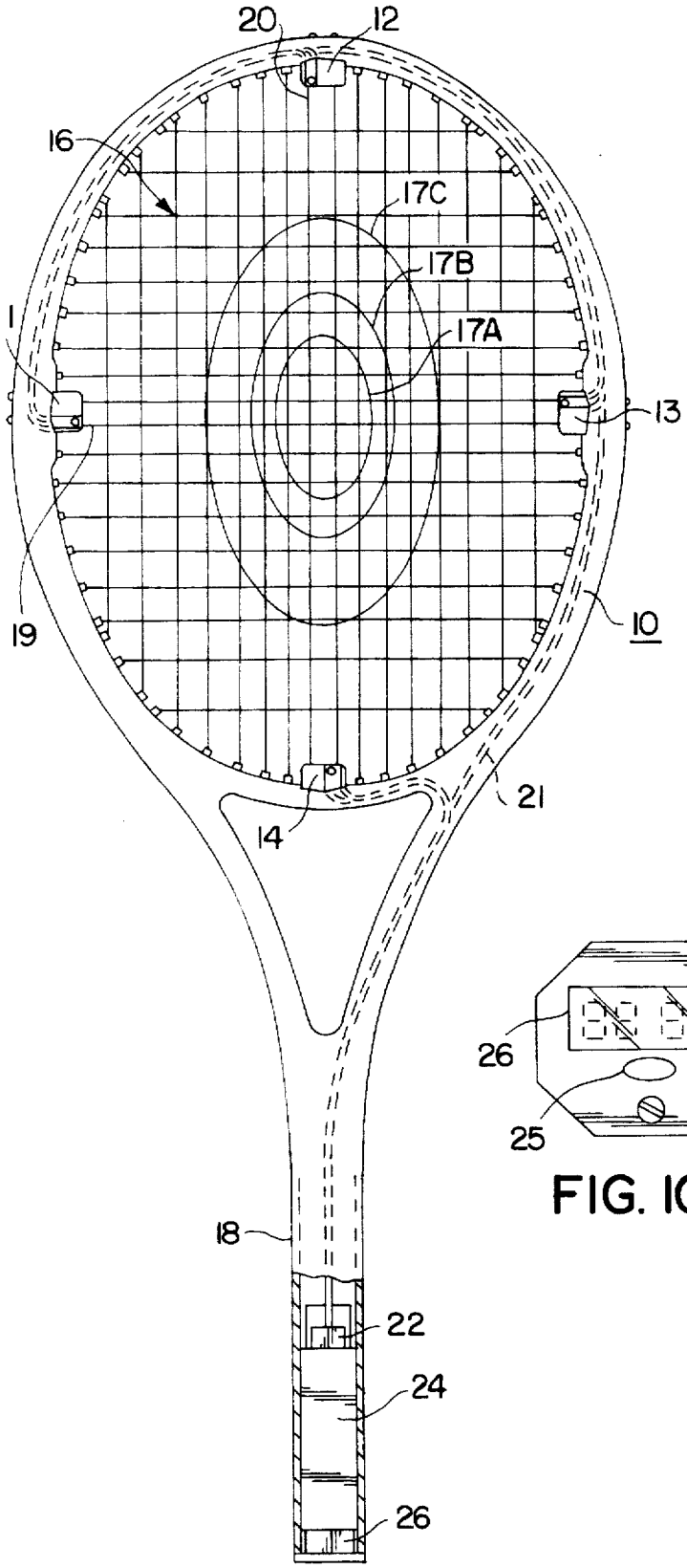
FIG. 1A is a plan view of a sports racquet incorporating an electronic apparatus for monitoring player performance in accordance with a preferred embodiment.
Figure 1C:
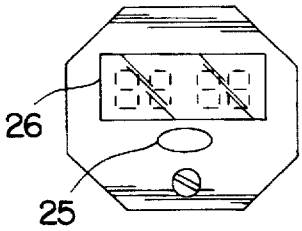
FIG. 1C is an end view of the sports racquet of FIG. 1A.
Figure 1B:
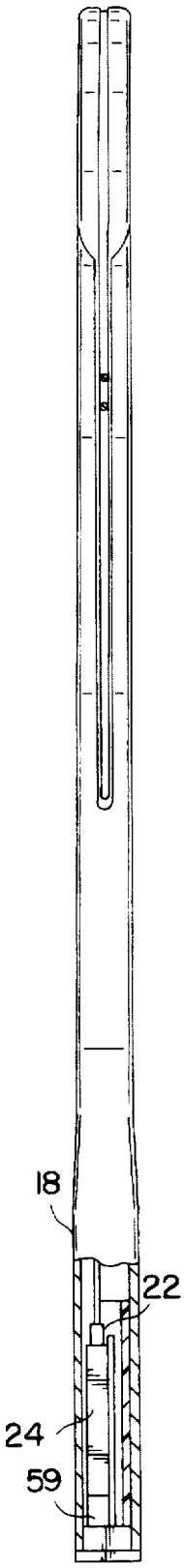
FIG. 1B is a side view of the sports racquet of FIG. 1A.

FIGS. 1A, 1B, and 1C illustrate an apparatus in accordance with a preferred embodiment of the invention for monitoring a player's performance. The sports racquet of FIG. 1A includes a string bed 16 supported on a frame 10.

Four sensors 11, 12, 13 and 14 are orthogonally mounted around the periphery of the string bed. Each of the sensors 11, 12, 13 and 14 is coupled to a string of the string bed. The sensors 11, 12, 13 and 14 are arranged in pairs 11 and 13 and 12 and 14 to detect the wave front of a transverse wave induced by the impact of a sports ball with the string bed 16. The sensor pairs 11, 13 and 12, 14 provide relative time-of-arrival signals for the transverse wave which can, through the use of the invention, identify the impact location on string bed 16.

The relative time-of-arrival of the transverse wave travelling at approximately 105 micro-seconds/inch, to each of the sensor pairs 11, 13 and 12, 14, is related to the position of the impact location with respect to each of these sensors. Thus, the first sensor to sense the impact will be the sensor closest to the point of impact, and the last sensor to sense the impact will be the furthest from the point of impact. The relative time-of-arrival signals produced from sensors 11, 12, 13 and 14 provide an indication of the relative distance between the impact location and each of the sensors.

A processing unit 24 maintained within the handle 18 of the sports racquet 10 is connected via a wiring harness 21 to the sensors 11, 12, 13 and 14, and is programmed to compute from the time-of-arrival signals produced by the sensors 11, 12, 13 and 14, the impact location on string bed 16. A display 26 supported in the end of the handle 18 is connected to display information related to the impact location determined by the processing unit 24. An audio signal/generator 59 is also provided on the processing unit 24 to provide an audible signal through a port 25 on the end of the racquet representing an impact within a selected zone.

The display 26 may advantageously display a quantity related to the number of impacts located within one or more zones delineated on the string bed 16. Zone 17A is known to sports players as the most desirable location for an impact. The outside succeeding zones 17B and 17C are progressively less desirable for playing sports. The players performance may be monitored by analyzing the number of impacts located within the preferred zone with respect to those impacts which occur outside the preferred zone as will be evident from the description. The present invention, as exemplified in FIG. 1, is capable of resolving the point of impact on the string bed 16 with respect to a selected zone. Each impact position with respect to a selected zone is tallied by the processing unit 24. Thus, the display 26 will, for instance, display the percentage of impacts within the desirable zone 17A with respect to the total number of impacts. The sports racquet monitoring device of FIG. 1A may also tally the impacts within the other zones 17B and 17C, representing a desired performance goal for less skilled players, and report these impacts as a percentage of total impacts as well.

The processing unit 24 employs a user interface which permits selections of various options for execution by processing unit 24. The user interface decodes a unique sequence of taps adjacent specific sensors 11, 12, 13 and 14 to select a particular option for execution by the processing unit 24.

The processing unit 24 is connected via an external connector 22 to a cable 21 carrying a pair of conductors for each of the sensors 11, 12, 13 and 14. As will be evident from the following description, the time-of-arrival signals produced by the respective sensors are measured and resolved by processing unit 24 into impact coordinates which may be located with respect to one or more zones 17A, 17B or 17C on the sports racquet string bed 16.

Figure 2:
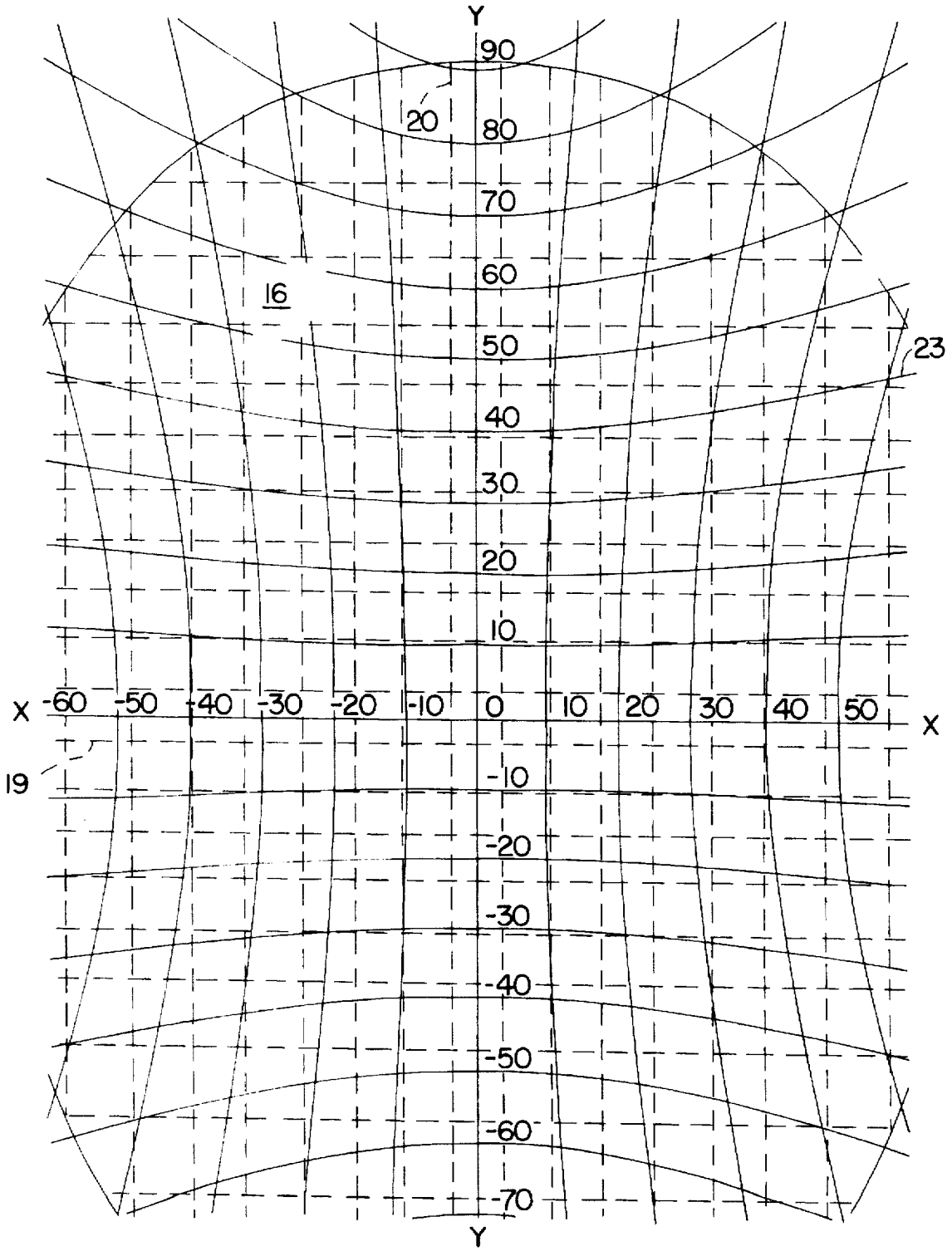
FIG. 2 illustrates the use of a curvilinear coordinate system over the string bed of a racquet to locate an impact on the sports racquet string bed 16.

In accordance with the preferred embodiment of the invention, time differences between signals produced from an opposite pair of sensors 11, 13, and 12, 14 are related to the positional coordinates (X,Y) on a curvilinear coordinate plane on string bed 16 as is shown in FIG. 2. This embodiment utilizes a technique whereby the coordinates of the predefined zones and the impact locations are determine relative to a particular curvilinear coordinate system. This particular coordinate system was mathematically derived such that the measured time difference as seen by a sensor pair such as pair 12 and 14 is exactly the same along any corresponding coordinate line. For example, the relative time-of-arrival signals as seen by Y axis sensors 12 and 14 are the same for all transverse waves produced by impacts occurring on line 23. The scale factor used for the curvilinear system is chosen to provide the required resolution and it utilizes decimal notation for convenience in defining zones. The X—X coordinate of the sports racquet of FIG. 1 and Y—Y coordinate of FIG. 1 are shown in FIG. 2, along with a series of curved lines superimposed on the string bed 16. The first transverse wave front detected on a string 19 or 20 coupled to a pair of the sensors 11 13 or 12 14, produces a signal representing the wave front of a transverse wave created by the impact of the sports ball with the string bed 16. An impact on string bed 16 of FIG. 1 which produces a zero time difference between the signals produced by sensor pair 11 and 13, lies along axis Y—Y. Impacts to the right of the Y—Y axis are illustrated as a positive time differential, whereas impacts to the left are shown as a negative time differential.

The preferred embodiment correlates the location of preferred impact zones or areas for various player skill levels on the string bed to each detected impact. Each coordinate line represents locations corresponding to a single time difference from a respective sensor pair. The time-of-arrival signals from one pair of sensors identifies one line, and taken with the time arrival signal from the second pair of sensors, which identifies a second intersecting line, a single location on the curvilinear system is determined. Since each preferred zone has been correlated to the coordinate system, an impact within a preferred zone may be expediently determined.

As impact locations move from the origin zero along the Y—Y axis, a similar time differential between signals produced from sensors 12 and 14 are produced which indicate the impact location relative to each of the sensors 12 and 14.

FIGS. 3A, 3B, 3C and 3D illustrate the arrangement of a typical sensor which is supported in a housing 39 fastened to the sports racquet 10, and which contacts a string 19 of string bed 16. Each of the sensors 11, 12, 13 and 14, supported on the racquet 10 is a cantilever assembly which includes a mylar contact arm 27 cemented to a piezoelectric film 28 such as Polyvinylidene fluoride 28 um thick, having metallization on each side thereof serving as electrodes 30, 31. The mylar contact arm 27 is typically approximately 10 mils thick and contacts the string 19 of string bed 16 at one end under pressure against the string 19. A layer of polycarbonate 29 acts as a brace and maintains the piezoelectric film 28 in contact with the mylar arm 27. A damper 40 comprising a 0.025 inch thick foam tape provides stiffening and damping action of the cantilever arm. The assembly is designed so that the cantilever arm is under pressure against a string 19. The transverse wave generated by a ball impact with the string bed causes bending of the cantilever assembly. The bending of the assembly applies a force to the piezoelectric film to produce a voltage across the electrodes in accordance with $V_o=\pm g_{3x}\cdot S\cdot t$, where $g_{3x}$ is the piezoelectric coefficient for the particular film 28, S is the longitudinal stress applied to the piezoelectric film 28 and t the thickness of the film. The polarity of the voltage is dependent upon an increase or decrease in applied stress.

Figure 3A:
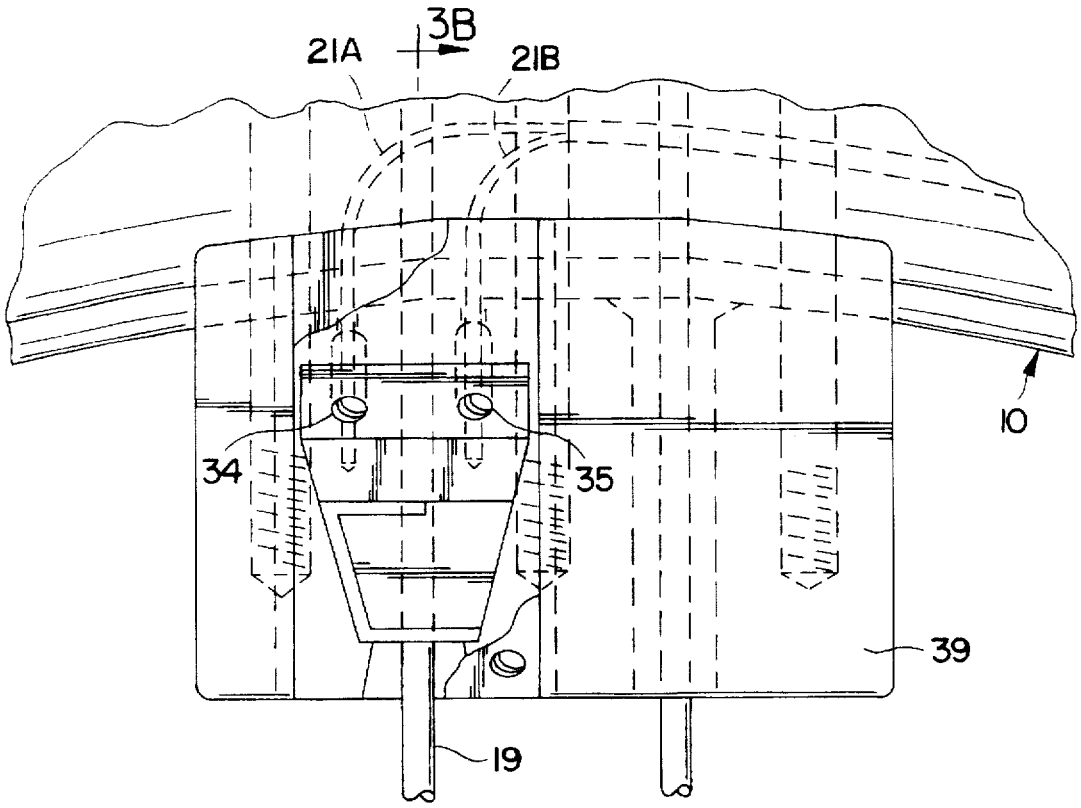
FIG. 3A is a plan view of a sensor housing 39 mounted on the sports racquet 10.
Figure 3B:
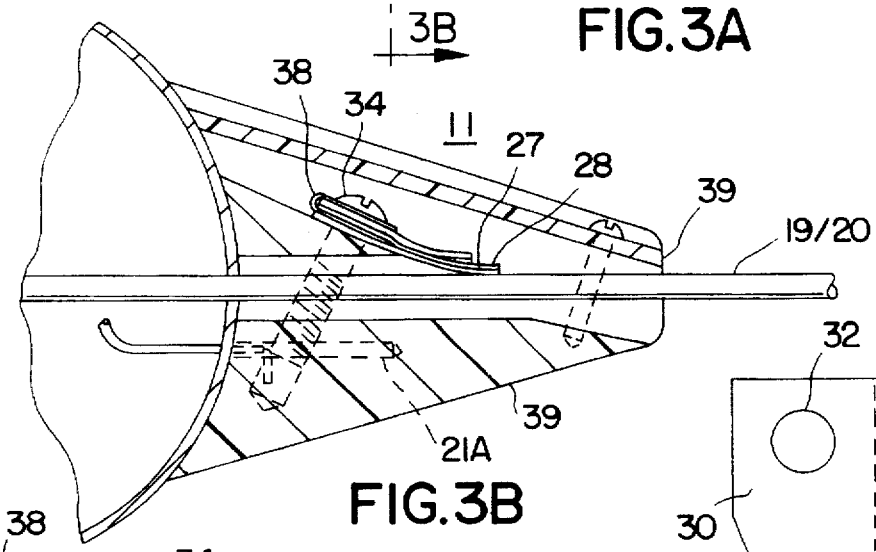
FIG. 3B is a section view of the sensor mounted in its housing.
Figure 3C:
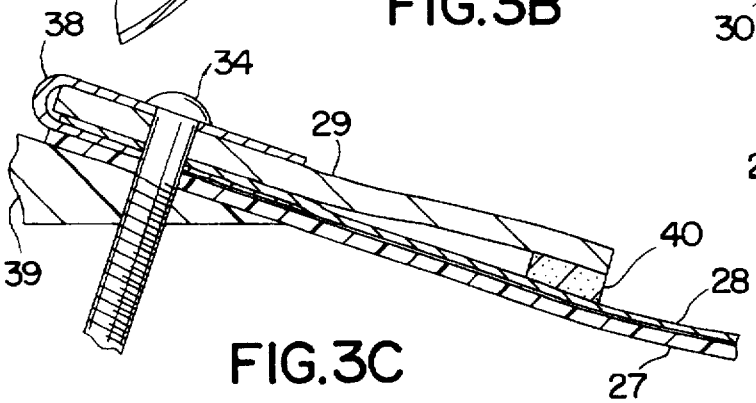
FIG. 3C is an enlarged view of the piezoelectric sensor and its mounting support of FIG. 3B.
Figure 3D:
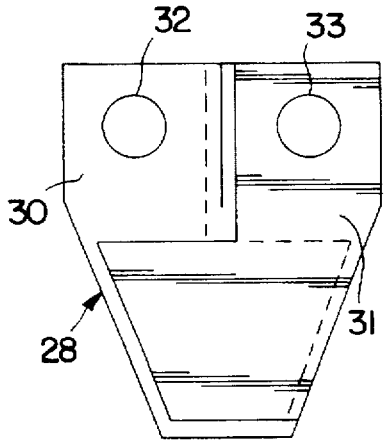
FIG. 3D is a top view of the piezoelectric film of the sensor showing the partial metallization removal.

FIG. 3D illustrates the piezoelectric film 28 in greater detail. Portions 30, 31 of the metallization are removed respectively on both the top and bottom of film 28 to create a pair of contacts which serve as electrodes. As shown in FIG. 3D, two screw holes 32, 33 are provided which receive screws 34 and 35 which connect the wires 21*a* and 21*b* to the remaining metallization layers on each side of the film which serve as electrodes for the sensors. The metallization layer on the bottom of the piezoelectric film 28 is connected to the top of the screw head 34 by a clip 38. Similarly, a second identical clip 38 connects the top metallization layer to the screw head 35. A small spacer 40 maintains the distal end of polycarbonate 29 spaced from the piezoelectric film 28.

Figure 4:
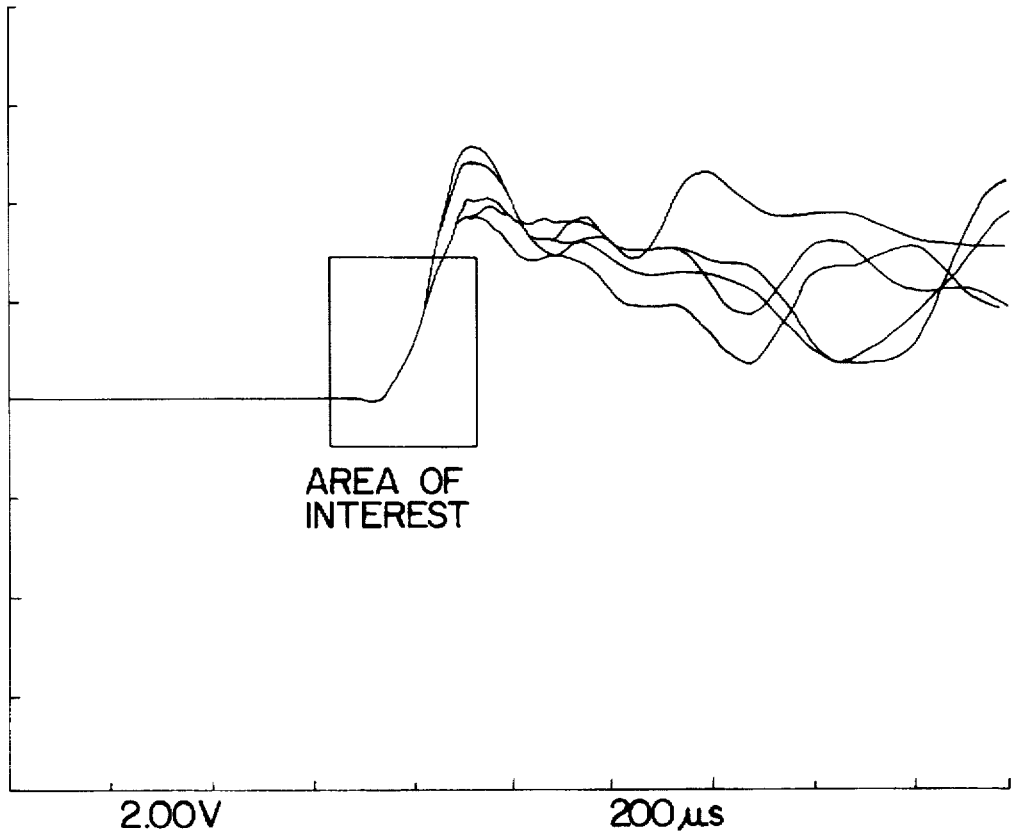
FIG. 4 illustrates five sensor output signals produced in response to five different impact created transverse waves on string bed 16.

The transverse wave which arrives at a sensor produces one of the signals shown in FIG. 4 having an initial rise time which establishes a reference timing point from which time differences between sensors may be established.

FIG. 4 illustrates for a single sensor how each of 5 impacts, at the same location, produces five signals having a detectable and consistent leading edge which may be accurately detected. The processor 24 is arranged to commence timing from a point along the slope of the leading edge of the signal from the first sensor to detect an impact. The remaining sensors provide a signal similar to that of FIG. 4 displaced in time. The relative position of the leading edge of the signals produced by the remaining sensors with respect to the first sensor provides the relative information necessary to identify the impact location.

Figure 5A:
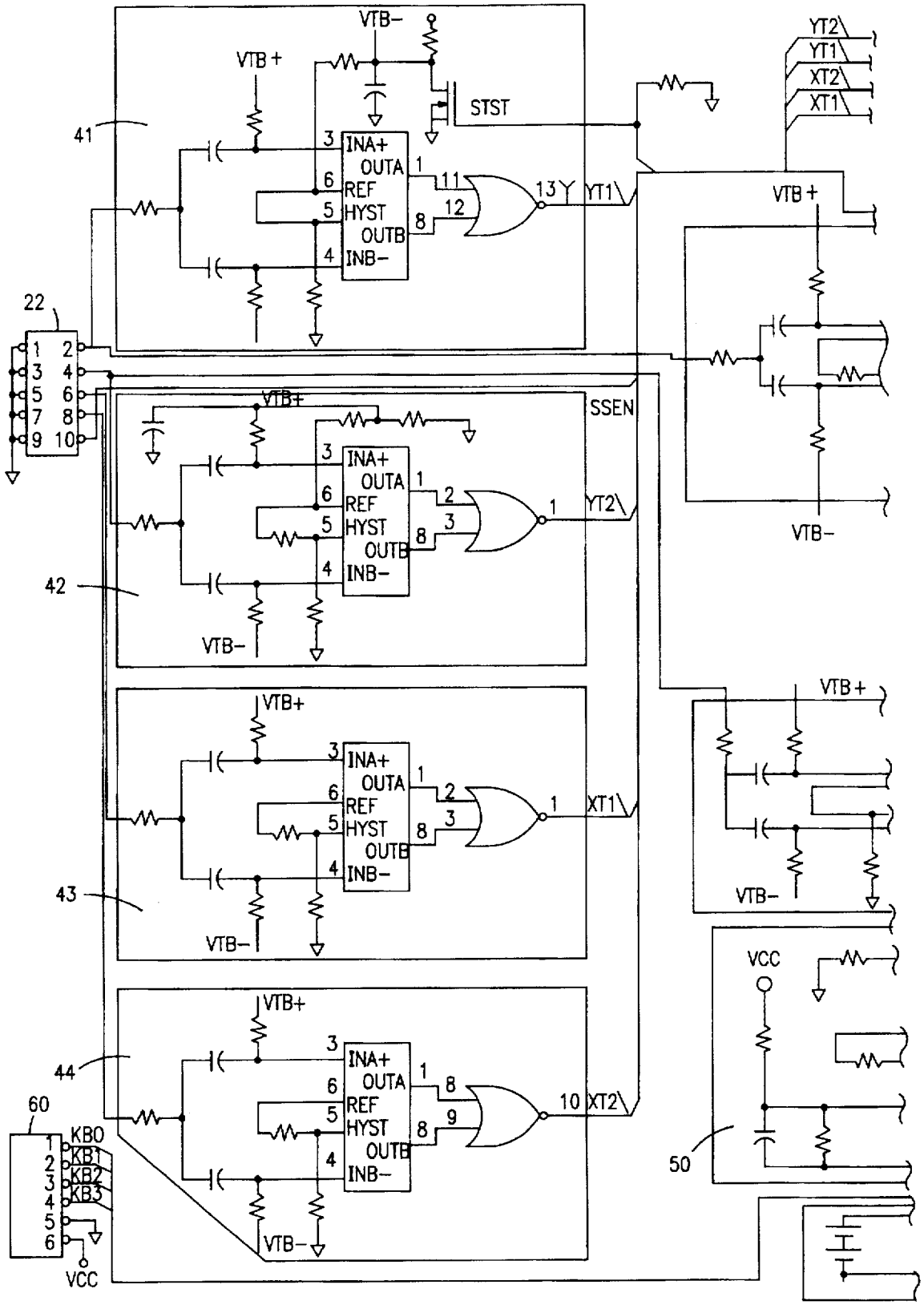
FIGS. 5A and 5B constitute a schematic drawing of the processing unit 24.
Figure 5B:
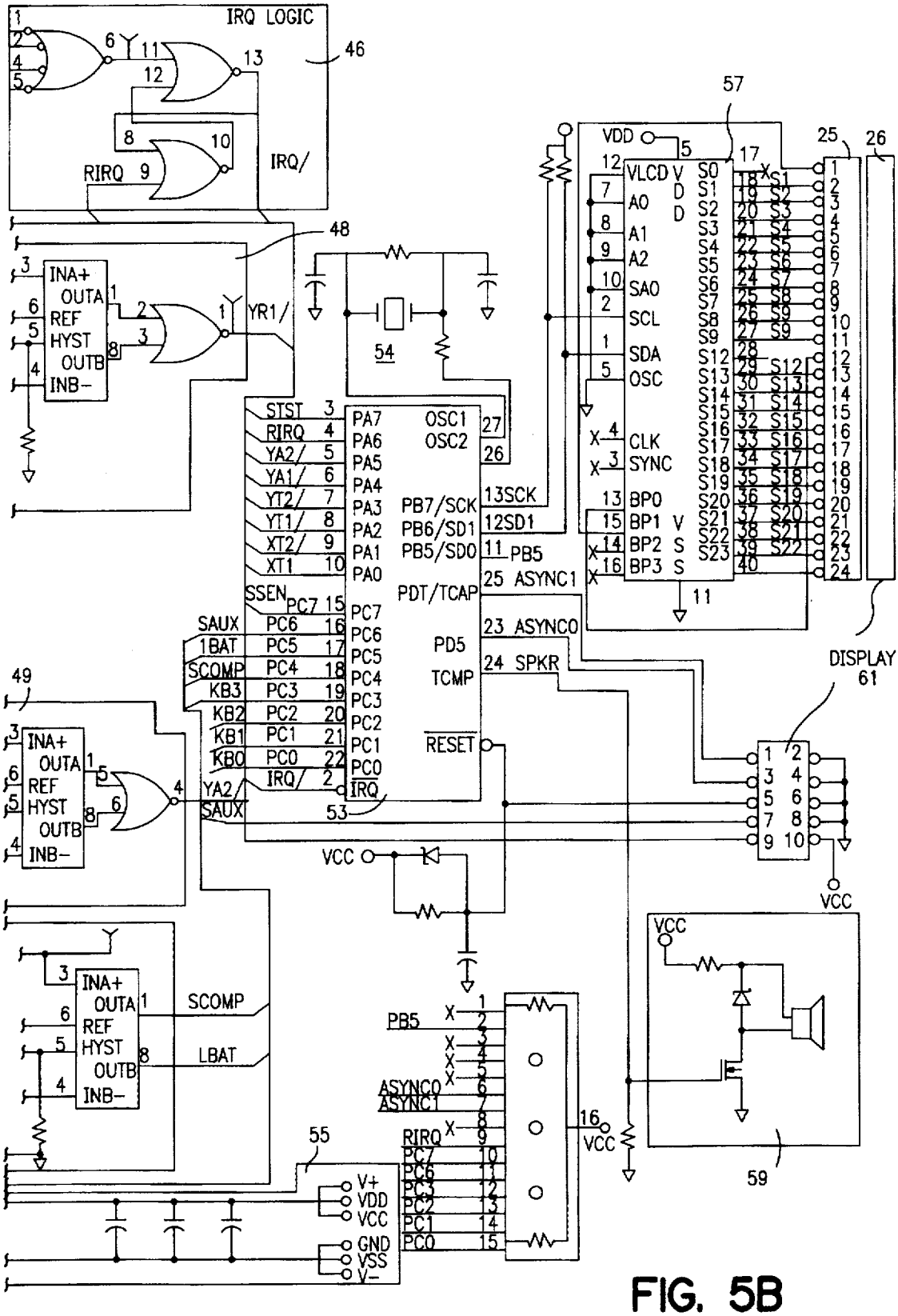

FIGS. 5A and 5B illustrate the configuration of the processing unit 24 and its peripheral electronics for processing the time-of-arrival of signals produced from sensors 11, 12, 13 and 14, and resolving the differences in time between signals into an impact location. A connector 22 on the processing unit 24 is connected to the ribbon cable 21 having a pair of leads connected to each sensor 11, 12, 13 and 14. The output signals from sensors 11, 12, 13 and 14 are received by a respective comparator circuit 41, 42, 43 and 44. The comparator circuits 41 through 44 compare the received signals to a reference voltage, utilizing a hysteresis type comparator circuit. The outputs of each of these comparator circuits YT1, YT2, XT1 and XT2 are combined in interrupt logic circuit 46 which generates a common IRQ signal when one of the sensors 11, 12, 13 or 14 produces a signal which exceeds the reference value of its respective comparator circuit 41 through 44. The IRQ signal during a play mode, initiates timing for measuring the time interval between a signal from the first sensor and the signals produced from the remaining sensors which detect the transverse wave.

Signals produced from each of the comparators 41 through 44 are each connected to an input of a microprocessor 53 which operates from a clock signal produced from clock circuit 54. In the preferred embodiment of the invention, the clock signal speed is selected to be 1.8 Mhz as a compromise between the necessary resolution for determining the impact location and battery power consumption. The processor 53 receives as additional inputs the interrupt signal IRQ from interrupt circuit 46 as well as signals from comparator circuits 48 and 49. Comparators 48 and 49 compare the absolute value of the signal produced from sensors 12 and 14 to a second reference level as an additional check on whether or not the impact detected on the string bed 16 has produced signals from sensors 12 and 14 that may be reliably detected. The processor 53 uses signals YA1, YA2, YT1 and YT2 to detect whether the sensor signal has at least a minimum rise time. Comparator 48 and 49 have a reference threshold which exceeds that of comparators 41–44, thus introducing a check on signal amplitude. Any impacts that produce a signal below a minimum reference amplitude and slope are ignored by the processor 53. The time difference between YA1 and YT1, and YA2 and YT2, are indicative of the slope of the signals detected by sensors 12 and 14. A third amplitude comparator circuit 50 is used to indicate when the battery power supply 55 potential is below a reference level to signal the user that the batteries should be replaced.

A display driver 57 is shown which receives data SD1 and a related clocking signal SCL from the processor 53. The display driver 57 may be a segment display driver for an LCD display 26. Each of the LCD segments is driven from an output line of the display driver 57 via connector 25. LCD display 26 displays information relative to the point of impact, such as number of impacts within a desired zone, or percentage of impacts in the desired zone.

An audio driver circuit and transducer 59 is shown for producing an audible signal in response to a decoded output TCMP of microprocessor 53. The audio driver circuit and transducer 59 may advantageously generate a sound having a frequency, duty cycle, and/or amplitude related to the impact location which has been resolved by the microprocessor 53.

The processing unit 24 includes a keyboard input connector 60 as well as an asynchronous port 61 which may be accessed to either program the microprocessor 53 with special software changes and/or recover data stored within the processing unit 24.

Figure 6:
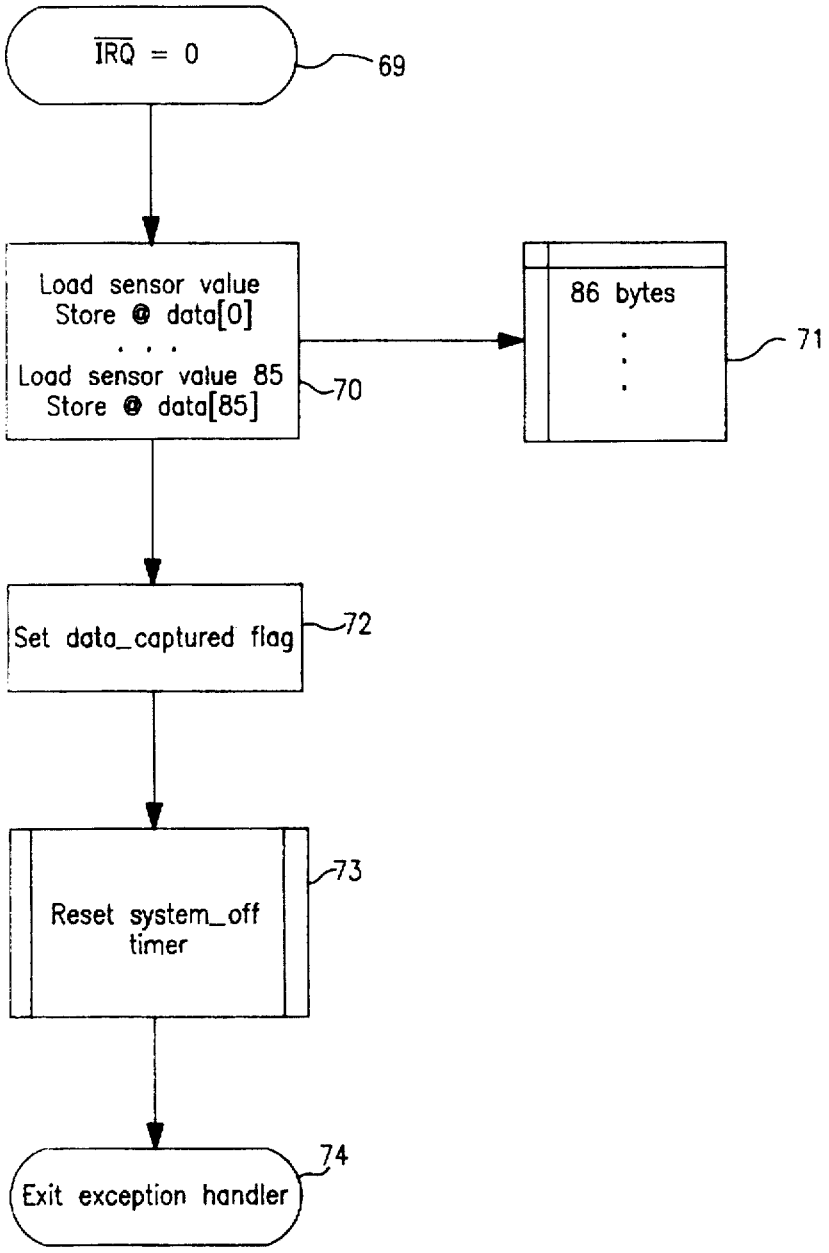
FIG. 6 is a flow chart illustrating the data capture routine for creating an array of data representing the time each sensor detects an impact the string bed 16.

The process of determining an impact location from the time-of-arrival signals produced by each of the sensors 11, 12, 13 and 14 is illustrated in FIG. 6. The start of a measurement interval in response to a ball impact with the string bed 16 occurs when an interrupt IRQ is produced from latch 46 of FIG. 5B in step 69, indicating that the sensor closest to the impact position has detected the leading edge of a transverse wave propagated towards the sensor. The microprocessor 53 then begins a cycle of writing a six bit word in 14 microsecond intervals, comprising the following data:

YT1 YT2 XT1 XT2 YA1 YA2.

The writing operation initiated by the IRQ interrupt constitutes eighty-six load and store instruction pairs, producing an array 71 of 86 locations, each location being six bits wide containing the data YT1, YT2, XT1, XT2, YA1 and YA2. The location in the array containing an active condition for YT1, YT2, XT1 and XT2 represents the times of arrival of the transverse wave to their respective sensors relative to the time-of-arrival of the transverse wave to the first sensor to detect the transverse wave. Once the full array of the foregoing data is obtained, a flag is set in step 72 indicating that an array of time-of-arrival data has been produced for identifying the impact location on the string bed 16. The system timer which was initiated from an interrupt 69, is then reset in 73 by the SET DATA captured flag 72. The system timer will remain reset until a subsequent impact producing an interrupt IRQ is detected. The system exits the IRQ routine after the 86 load and store cycles are completed.

Figure 7:
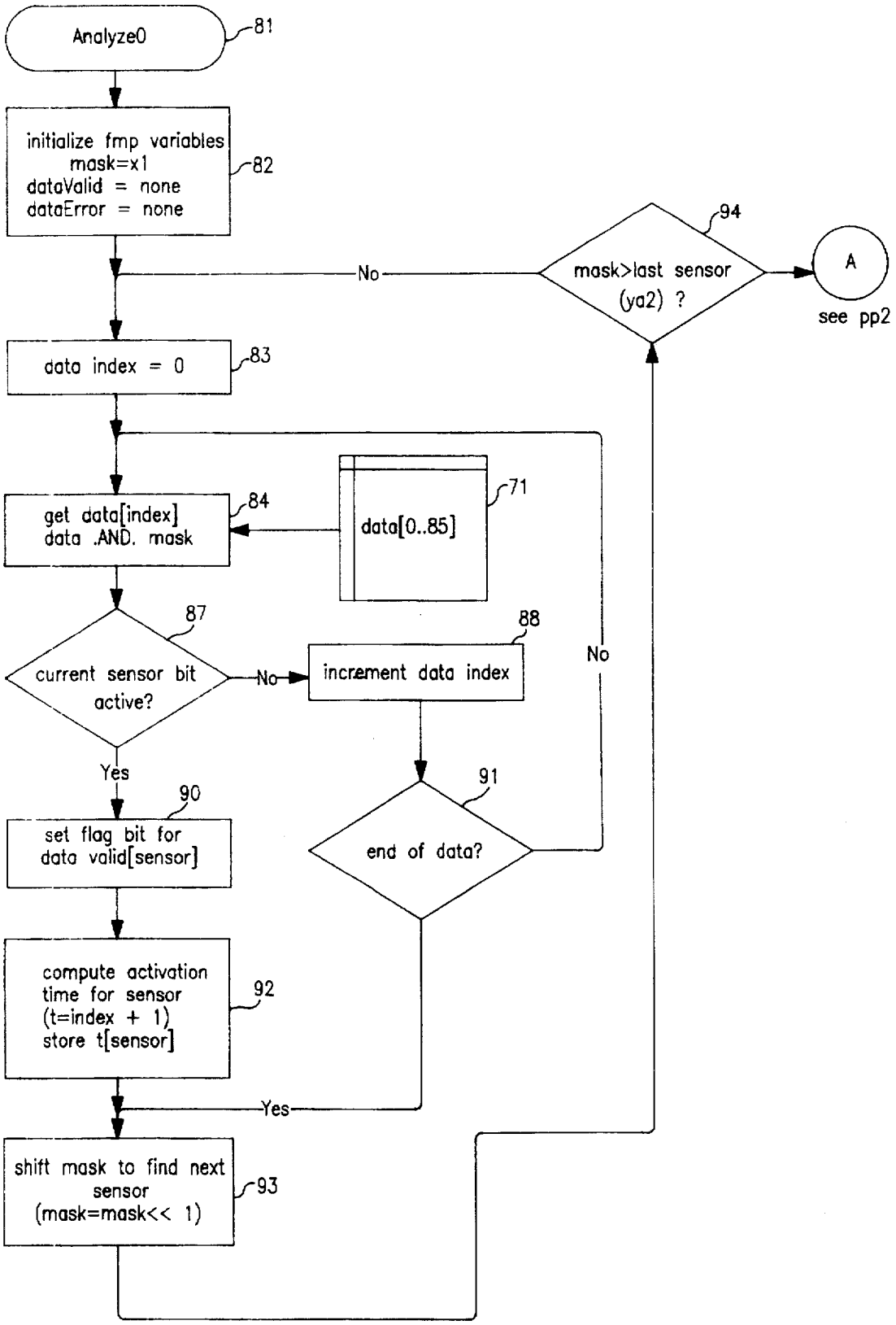
FIG. 7 is a flow chart illustrating the routine for analyzing the data in array 71.

FIG. 7 illustrates the data analysis routine executed by the software within microprocessor 53 for determining the location in array 71 of positions which indicate an active position for each sensor. These positions represent the timing relationship between sensors. The software execution depicted in FIG. 7 determines the elapsed time, between the interrupt and the occurrence of sensor input signals YT1, YT2, XT1 and XT2. The entire array is scanned by the process depicted in FIG. 7 using a mask for each of the six bits representing XT1, XT2, YT1, YT2, YA1 and YA2. Once the active conditions for each of the sensors is located in the array 71, the program exits to FIG. 8 where the actual position in terms of X and Y coordinates within the string bed are determined and saved.

Figure 8:
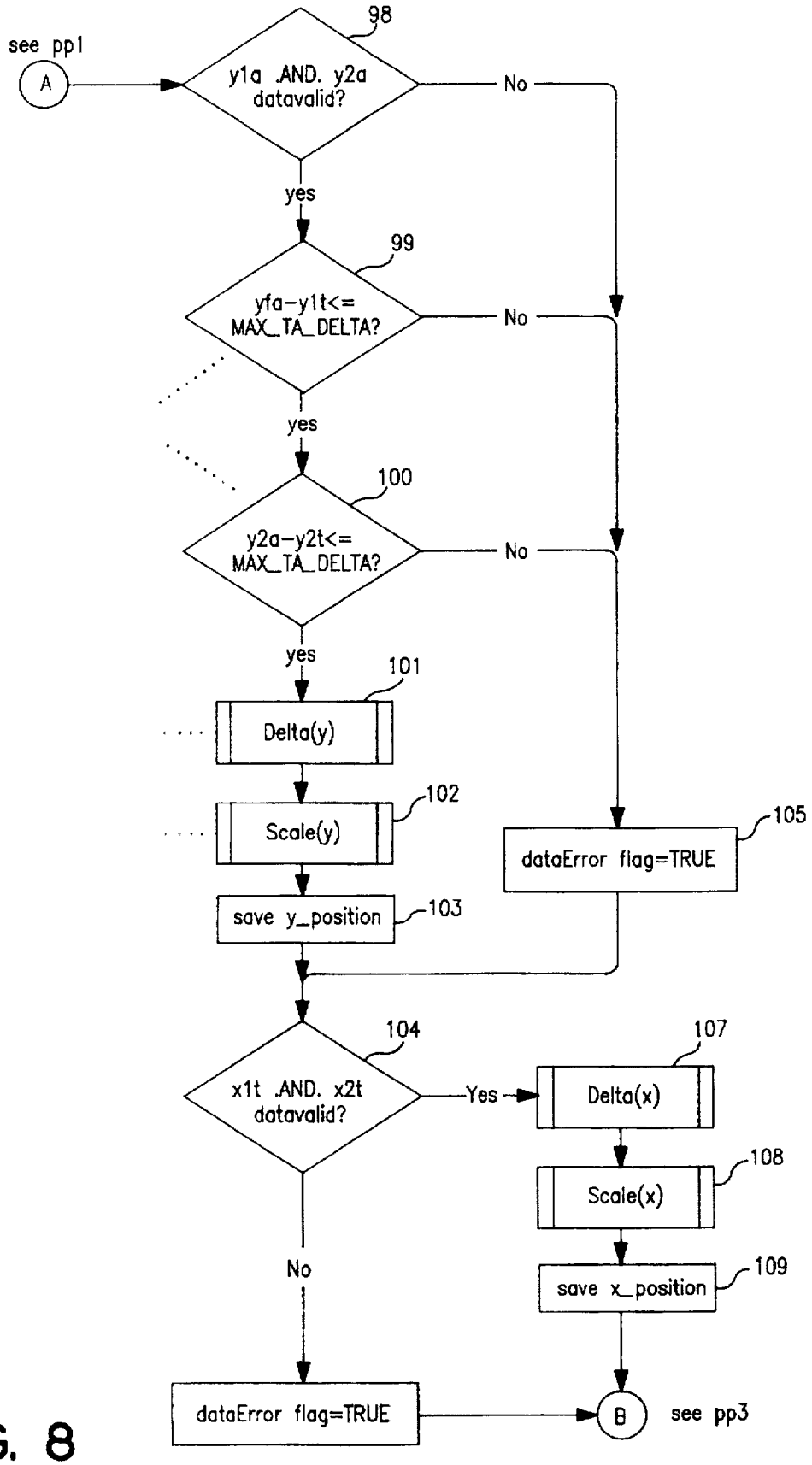
FIG. 8 is a flow chart of the data analysis routine for converting the timing data of FIG. 6 to positional information.

The detailed description of FIGS. 7 and 8 is as follows.

The analyze routine 81 is entered following a data capture, and a mask is created in step 82 to search for each of the active values XT1, XT2, YT1, YT2, YA1, YA2 within the array 71. Each bit location XT1 of each six bit word in the data array is checked in step 84 with the first mask location representing the first quantity XT1. Step 87 checks the first six bit location in data array 71 for XT1, and if it is not found to be active, i.e., 1, the index is incremented in step 88 and the next location and following locations, each which represents 14 μs time intervals within the data array 86 are checked for an active value of XT1.

When an active value is found in a memory location matching the mask bit, a flag is set in step 90 and an activation time for the sensor is computed from the memory location containing the bit, corresponding to (index +1) and stored in step 92. The mask is then shifted in step 93 to find the next quantity, XT2 and the process is repeated for each of the bit positions in the data array 71 to locate the location in array 71 containing an active bit position for XT2. When the remaining locations containing active values representing YT1, YT2, YA1 and YA2 have been found in the data array 71, the software exits in step 94 to the routine of FIG. 8.

Before computing an impact location from XT1, XT2, YT1 and YT2, the routine of FIG. 8 will validate the YT1 and YT2 in step 98 by determining that amplitude check bits YA1 and YA2 have been found active. Steps 99 and 100 provide a further quality check on the sensor signals by computing the slope of the sensor signals produced by sensors 12 and 14. The slope is a function of the time between the signals YT1, YT2 produced from comparators 41 and 40, with respect to the signals YA1, YA2 from circuits 49 and 50 of FIG. 5. If the time differences ΔT represented by these signals is greater than a minimum slope value, the process continues by calculating the time differences representing coordinates of the impact location. In the event that the minimum slope has not been determined for the signals from sensors 12 and 14, an error flag is set in step 105 and the impact is ignored.

When a valid slope calculation is obtained, YT2 is subtracted from YT1 in step 101 to obtain a time differential ΔY. The time differential ΔY is scaled and an offset added to obtain a Y—Y coordinate in step 102. The calculated coordinate is saved in step 103 and the process continues to calculate a coordinate along the X—X axis.

Assuming that outputs XT1 and XT2 were found within the array during the process of FIG. 7, as determined in step 104, a time difference ΔX representing the time difference between the XT2 value and XT1 value found in step 92 of FIG. 7 is determined in step 107. This value is scaled in step 108 and saved in step 109 as an X coordinate. If no valid XT1 or XT2 values are found, decision block 104 sets error flag 110 to true.

The Y and X calculations determine the location of the impact. Each report zone 17A, 17B and 17C of FIG. 1 can be defined in a table representing each zone. For each value of X, two maximum values for Y may be defined in the table. Thus, after computing the value of X, a first look-up table is addressed with the value of X and the values produced from the look-up table, representing an upper and lower Y are compared against the measured Y value to determine the if impact is within the zone.

The foregoing technique requires only coordinates for one side of X of FIG. 2. Thus, if the zone is circular, about the origin O, storing all permissible maximum value for Y for one half of the circle would require approximately 150 data points.

Using the foregoing technique for determining whether an impact is within a zone permits programmable tables to be provided so that different skill levels will have differently defined zones.

Once the location of the impact with respect to the zone has been determined, a command is generated from the microprocessor 53 to the display driver 57. At the same time, a sound byte having an amplitude, duty cycle, and frequency component representing the impact location as inside the zone is generated and the user hears a distinct audio sound produced from the transducer 59, identifying the impact location as within the zone.

Each impact is tallied as a total number of impacts and the number of impacts within the selected zone. A display routine is invoked by the microprocessor for displaying a quantity representing the total number of impacts versus the number of impacts within a selected zone.

Instead of, or in addition to an alpha numeric display, a dot matrix or graphic display may be incorporated as display 26 for displaying a plurality of illuminated pixel elements for identifying the location of each impact from the calculated X and Y locations. The pixel display uses a memory map to derive a pixel location from the calculated X and Y locations.

The foregoing demonstrates that the device is capable of determining the impact location on the string bed 16. Once this location is known, the results may be displayed in any convenient format, i.e., such as the foregoing percentage of impacts within a given zone, or with a bit mapped pixel or graphic display.

The processing unit 24 includes a user interface which permits selecting a zone based on the user's proficiency level, as well as numerous other user selectable parameters.

Figure 9:
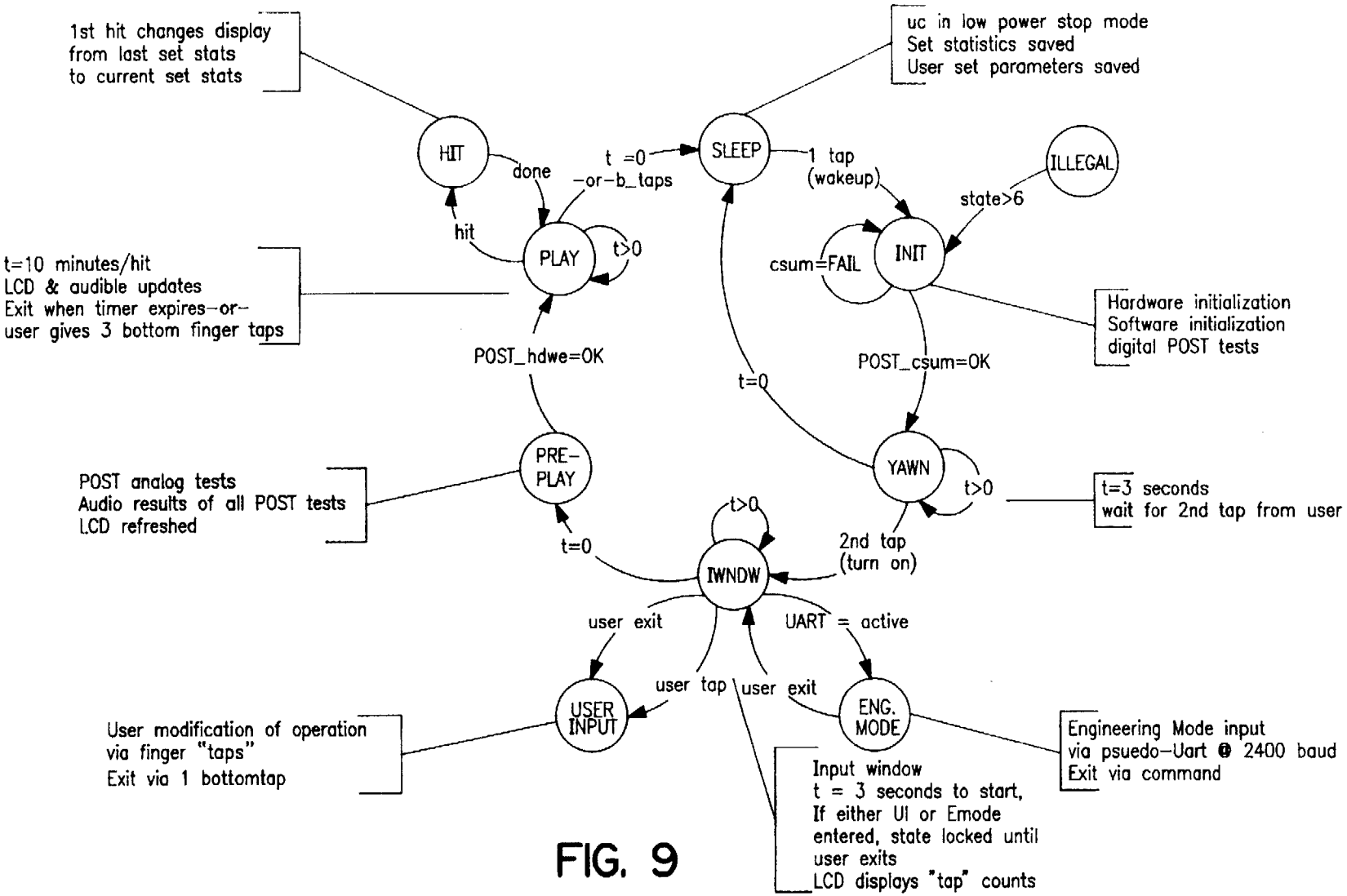
FIG. 9 is a state diagram for the microprocessor 53.

FIG. 9 illustrates an execution state machine for the processing unit 24. A SLEEP mode is the mode when the device is in its unused state. At the time the sports racquet is to be used for gathering performance measurements, a single mechanical tap in the area of sensor 12 will result in an interrupt being generated from interrupt circuit 46 of FIG. 5A, and a signal is produced at the output of comparator circuit 42.

The sensed interrupt and signal produced by comparator 42 will result in microprocessor 53 entering a HARDWARE INIT routine. This routine includes a self check of the microprocessor 53.

Following a self-check, the microprocessor 53 checks for a second signal from sensor 12 within a three second window. The sensed second tap initiated by the user brings the microprocessor 53 from the YAWN state to a turned on active state IWNDW.

At this time, the processor 53 will be ready to be initialized, either through the async port 61 or keyboard port 60 of the processor, by any conventional data entry means connected to the processor 53 or by the user continuing to tap in the vicinity of sensor 12 or the other sensors 11 and 13 to provide coded instructions to the microprocessor 53.

In the IWNDW mode numerous user programming options may be selected. The user may, for instance, input commands to the microprocessor 53 for selecting the particular zone identified in FIG. 1 for the particular user. The first zone 17*a*, for the more experienced users, is selected by tapping at sensor 11, which also initiates an interrupt to the processor 53, resulting in a decoding of the output of the comparator circuit 42. Each tap on this sensor selection increments the zone mode to successively select zone 17A, zone 17B1, and 17C representing skill levels A, B and C respectively. The additional programming options are described more particularly in Table II.

The statistical features of the device permit reporting and displaying total play impacts since the last battery change, number of impacts within the selected report zone, etc., is selected by tapping the sensor 11 four times.

The following is a summary of the protocol for carrying out programming of some of the features of the microprocessor 53.

TABLE I

USER PROGRAMMING

Two taps on the strings near any sensor turns on the system and initiates the Wake-up period. Following the Wake-up period, the system enters the Programming Window period, anticipating that the user may want to program something. The LCD display reads "USER SET".

A tap near any sensor while USER SET is displayed [about 4 seconds] initiates the Programming Mode.

TOP [SENSOR 12]:

- Tap codes [defined below] select the particular Function to be modified

EITHER SIDE [SENSOR 11 OR 13]:

- Tap codes selects the particular item [Selection] within a function

BOTTOM [SENSOR 14]

- Normally used to terminate the Programming mode
- 3 taps in quick succession during the Play period puts the system into the Stop mode. This action is necessary so that the user can get into the Programming mode to turn-off the tones, etc.

USER'S SETTINGS MEMORY

- Retention of User settings is dependant upon continuous battery power
- Loss of battery power will result in the micro automatically restoring the settings to factory defaults as shown on the following table.

| Func | Sel | Bot | FD | Action |
|---|---|---|---|---|
| | | 1 | | Terminates User Programming mode, sets last function parameters selected, and continues on to SIT period. |
| 1 | | | | Tone Control |
| | 1 | | * | Turn on hit tone report [♪ on LCD] |
| | 2 | | | Turn off all hit tone reports [♪ turned off on LCD] |
| 2 | | | | Skill Level Selection [A, B, C, S displayed in lieu of selection #1] |
| | A | | | Select level A [A lights on LCD alphanumeric character] |
| | B | | * | Select level B [B lights on LCD alphanumeric character] |
| | C | | | Select level C [C lights on LCD alphanumeric character] |
| | S | | | Select S only [S lights on LCD alphanumeric character] |
| | A/S | | | Select level A and S [A&S alternate on alphanumeric character] |
| | B/S | | | Select level B and S [B&S alternate on alphanumeric character] |
| | C/S | | | Select level C and S [C&S alternate on alphanumeric character] |
| 3 | | | | LCD Display for play statistics |

TABLE I-continued

USER PROGRAMMING

| | | | | |
|---|---|---|---|---|
| | 1 | | * | Sweet total hits and total hits are alternated on the display |
| | 2 | | | % Sweet hits and total hits are alternated on the display |
| | 3 | note 1 | | Displays X and Y hit [curvilinear] coordinates on LCD |
| 4 | | | | User Statistics [Value alternates with F4S1(2)] |
| | 1 | | * | Total play impacts since last battery change |
| | 2 | | | % Sweet hits since last battery change |
| 5 | | | | Restore [Action occurs upon exiting Program Mode] |
| | 1 | | * | Do nothing [helps user to keep from inadvertently resetting] |
| | 2 | | | Reset sweet and total impacts counters |
| | 3 | | | Restore all functions to factory settings |
| 6 | | | | Service mode |
| | 1 | | * | Reports SW part number on LCD [Alternates with F6S1] |
| | 2 | | | Reports SW rev level on LCD [alternates with F6S2] |
| | 3 | note 1 | | Repeatedly runs SIT test, hangs on error and displays trouble code [Action occurs upon exiting Program Mode] |

Key: Func = function; Sel = selection; FD = factory default

Any number of functions can be selected and programmed in a User Programming period. Activation of a new function causes the selection for the previous one to be replace.

Except as noted, Function and Selection codes are displayed on the LCD as they are entered by the user. The format is a follows: [F8S8] where "8"s represent the numerical value of the function or selection as given in the table above.

Returning to FIG. 9, following the user programming of the device, a tap on the bottom sensor 14 will result in the microprocessor 53 entering a PREPLAY state. Assuming that the power on self-test procedure was successful, sounds are produced via the audio transducer 59 with a long and short tone set, recognizable to the user.

Following issuance of the tone set, indicating the POWER ON self-test functioned correctly, the system enters a PLAY MODE. The PLAY MODE in response to any subsequent interrupts, decodes the outputs of comparator circuits 41, 42, 43, 44, 48 and 49 in the manner described in FIG. 6–7, capturing the data produced each time an interrupt is produced in response to an impact on the string bed 16.

Following play, three taps on the sensor 14 are decoded as a command to place the processor in the SLEEP mode.

Thus, the device includes a complete user interface for setting the processor into the correct mode, and allowing a selection of various performance criteria to be reported.

What is claimed is:

1. Electronic apparatus for monitoring player performance comprising:

a plurality of sensors supported about the periphery of a string bed of a racquet for detecting the relative time-of-arrival of a transverse wave produced by an impact of said string bed with a ball;

circuit means connected to receive signals produced from said sensors to provide a plurality of signals from which the position of impact is calculated;

microprocessor means connected to receive said plurality of signals from said circuit means, said microprocessor being programmed to compute the impact location from said signals; and a display device on said racquet for visually displaying alphanumeric or graphic information representing the location of said position of impact on said string bed.

2. The electronic apparatus according to claim 1 where in said display indicates the relative location of said impact with respect to a predefined zone of said string bed.

3. The electronic apparatus according to claim 1 wherein said microprocessor is programmed to compare each impact location with a zone on said string bed.

4. The electronic apparatus according to claim 3 wherein said microprocessor maintains a tally of the total number of impacts and the total number of impacts within said zone.

5. The electronic apparatus according to claim 4 wherein said microprocessor is programmed to compute the relative number of impacts within said zone with respect to a total number of impacts to said string bed.

6. The electronic apparatus of claim 1 further comprising a signal generator for generating an audible signal representing an impact, and a transducer for producing an audible sound in response to said signal.

7. The electronic apparatus of claim 6 wherein said audible signal has a frequency content representing the relative location of said impact on said string bed.

8. An electronic apparatus for monitoring a players performance comprising:

a sensor array disposed about the perimeter of a string bed of a racquet for detecting an impact of said string bed with a ball;

circuit means connected to said sensor array for generating a plurality of time-of-arrival signals;

a microprocessor connected to receive said plurality of time-of-arrival signals and calculate from said time-of-arrival signals an impact location on said string bed; and means on said racquet connected to the microprocessor for indicating said calculated impact location to a user regarding the position of said impact on said string bed.

9. The electronic apparatus according to claim 8, further comprising a user interface for selecting a performance option for execution by said microprocessor.

10. The electronic apparatus according to claim 8 wherein said means on said racquet is an audible sound generator.

11. The electronic apparatus according to claim 10 wherein said audible generator produces an audible sound representative of said impact location on said string bed.

12. The electronic apparatus of claim 8 wherein said means on said racquet includes a visual display for displaying a visual indication of said impact location.

13. The apparatus of claim 8 further comprising means for signalling information concerning the impact to an external device.

14. An apparatus for determining a location of impact of a ball on a racquet string bed comprising:

a plurality of impact sensors disposed around the periphery of the string bed of said racquet:

circuit means connected to each of said sensors for generating a plurality of signals representing an impact location on said string bed; and microprocessor means having an interrupt for receiving a signal from said circuit means representing the first sensor to detect said impact; said microprocessor being programmed to:

sample each of said plurality of signals at a sampling interval for an indication of an impact; and store a value of each sample of said plurality of signals which represents each sensor signal for a plurality of sequential sampling intervals, wherein an array is created containing a plurality of data representing the location of an impact of said ball on said string bed.

15. The apparatus of claim 14 further comprising:

an amplitude detecting means connected to at least one of said sensors for detecting the relative amplitude of said sensor signal, said microprocessor means sampling and storing at each of said sampling intervals an indication each time said sensor signals exceed a reference value.

16. The apparatus of claim 15 wherein said amplitude detecting means detects the relative amplitude of first and second of said sensors which are positioned opposite each other around the periphery of said string bed.

17. The apparatus of claim 14 wherein said microprocessor is further programmed to:

determine from the position location of data in said array representing relative time differences between said sensor signals the relative position of impact of said ball.

18. The apparatus of claim 14 further comprising means for displaying the location of said impact.

19. The apparatus of claim 14 wherein said microprocessor is further programmed to compare each impact location determined from data in said array with a zone defining an area on said string bed, and maintains a tally of the number of impacts on said string bed.

20. The apparatus of claim 19 wherein said microprocessor displays an indication of the number of impacts within said zone.

21. The apparatus of claim 20 wherein said microprocessor includes a table of data defining a plurality of zones on said string bed, one of said zones being selectable by a user to compare with each impact.

22. The apparatus of claim 19 wherein said zone is identified by a look up table which provides an array of position data which identifies the boundary of said zone.

23. The apparatus of claim 18 further comprising a memory for containing a plurality of tables of position data, each table defining one of a plurality of concentric zones on said string bed, said microprocessor being further programmed to compare each impact location with data in one of said plurality of tables to determine whether said impact location correlates to a zone defined by said table.

24. The apparatus of claim 23 wherein said microprocessor is programmed to compute the total number of impacts to said string bed, and a total number of impacts within one of said zones.

25. The apparatus of claim 23 wherein said microprocessor is further programmed to display on said display means data related to the number of impacts within said one zone.

26. The apparatus of claim 25 wherein said display means displays data representing the percentage of impacts within said zone as compared to the total number of impacts to said string bed.

27. The apparatus of claim 24 wherein said display means displays data representing a total number of impacts on said string bed.

28. The apparatus of claim 23 comprising a user interface for selecting one of said zones.

29. The apparatus of claim 23 wherein said user interface comprises programming steps within said microprocessor for detecting tapping of one of said sensors, each succeeding tap representing a command to said microprocessor.

30. Electronic apparatus for monitoring player performance comprising:

sensor means supported on the periphery of a string bed of a racquet for detecting an impact of said string bed with a ball;

circuit means connected to receive signals produced from said sensor means to provide a plurality of signals from which the position of said impact is calculated;

microprocessor means connected to receive said signals, said microprocessor being programmed to compute the impact location from said signals; and means on said racquet connected to said microprocessor for providing information indicating said computed impact location.

31. The electronic apparatus according to claim 30 where in said means for providing information indicates the relative location of said impact with respect to a predefined zone of said string bed.

32. The electronic apparatus according to claim 30 wherein said microprocessor is programmed to compare each impact location with a zone on said string bed.

33. The electronic apparatus according to claim 30, further comprising a user interface for programming said microprocessor.

34. The electronic apparatus according to claim 30 further comprising a data port for communicating with an external data device.

35. The electronic apparatus according to claim 30 wherein said means on said racquet is an audible tone generator.

36. The electronic apparatus of claim 33 wherein said means on said racquet includes a visual display for displaying a visual representation of said impact location.

37. The electronic apparatus according to claim 31 wherein said microprocessor maintains a tally of the total number of impacts and the total number of impacts within said zone.

38. The electronic apparatus according to claim 37 wherein said microprocessor is programmed to compute the relative number of impacts within said zone with respect to a total number of impacts to said string bed.

39. The electronic apparatus of claim 30 wherein each impact is correlated to first and second coordinates of a curvilinear coordinate system by said microprocessor.

40. The electronic apparatus of claim 39 wherein said microprocessor compares said impact location on said curvilinear coordinate system with a zone defined by curvilinear coordinates stored in a table.

41. The electronic apparatus of claim 40 wherein said means on said racquet indicates whether said impact is within said zone.

* * * * *